United States Patent [19]

Zarriello

[11] 4,095,384

[45] Jun. 20, 1978

[54] BUILDING BLOCK WALL FABRICATING DEVICE

[76] Inventor: Daniel A. Zarriello, 422 N. Main St., Lodi, N.J. 07644

[21] Appl. No.: 724,382

[22] Filed: Sep. 17, 1976

[51] Int. Cl.[2] ..... E04B 2/00

[52] U.S. Cl. ..... 52/408; 52/442; 428/122; 428/491

[58] Field of Search ..... 52/442, 408, 415, 618, 52/105; 156/205, 208, 71, 210; 428/40, 59, 490, 491, 343

[56] References Cited

U.S. PATENT DOCUMENTS

| | | | |
|---|---|---|---|
| 158,651 | 1/1875 | Rowland | 428/491 |
| 1,025,443 | 5/1912 | Angier | 428/491 |
| 1,466,462 | 8/1923 | Bachman | 428/122 |
| 2,187,087 | 1/1940 | Leary | 52/105 |
| 2,687,034 | 8/1954 | Blanc | 52/408 |
| 3,346,105 | 10/1967 | Nye et al. | 428/40 |
| 3,648,835 | 3/1972 | Yucel | 428/343 |

FOREIGN PATENT DOCUMENTS

| | | | |
|---|---|---|---|
| 333,421 | 12/1958 | Switzerland | 52/442 |

*Primary Examiner*—J. Karl Bell

[57] ABSTRACT

At current high cost of materials and labor, a preferred embodiment of the present invention makes possible easy do-it-yourself erecting of building block walls of proper alignment and of sturdy structure with easy handling materials of a simple nature, including an elongated sheet strip of corrugated cardboard having tar coating upper and lower broad faces of the strip, with length-wise spaced-apart markers indicating consecutive length units, and having on each of lateral side faces the corrugated cardboard series of consecutive openings, with the strip width being less than the width of the blocks under which and above which foundation and/or tiers of blocks are to be mounted such that a groove is formed for each additional tier between that tier and the support foundation or tier therebeneath, into such groove a mortar or other binder composition is insertable to be pressed into the corrugation openings in which the mortar or other binder hardens to set-up securing the mortar or binder against the possibility of cracking away from and/or out of the groove(s) and welding the tiers solidly together, there being similar short fin strips between the end to end blocks with opposing end flat faces pressed flushly against opposite tar-coated faces and with the corrugated cardboard openings facing in each of opposite lateral side direction in directions axially perpendicular to front and back wall faces such that the mortar is pressed also into vertical grooves between end faces of serially consecutive blocks into the corrugated fin strip openings.

4 Claims, 8 Drawing Figures

BUILDING BLOCK WALL FABRICATING DEVICE

The present invention relates to a novel combination of elements for easy fabrication of building block walls.

BACKGROUND TO THE INVENTION

Prior to the present invention there have existed patents such as U.S. Pat. No. 2,687,034 disclosing adhesive gasket strips having upper and lower adhesive faces for adhering together consecutive tiers of building blocks as well as small gasket strips for adhering together abutting ends of serially arranged end-to-end blocks, the strips being made of solid moisture impervious material and being the same width as the blocks to be adhered together.

Such a combination of strips does not accomplish the goals of securing the mortar joints or in facilitating the utilization of mortar, and does not simplify the utilization of necessary mortar for cementing together end-to-end blocks and/or pile-up tiers of blocks, nor does such a set of strips serve to make possible the necessary simplicity of building a building block wall as would be required to entice the amateur to undertake such a venture devoid of prior experience or guidance. Also, heretofore, prior to the present invention, there have not been available any combination of elements of sufficiently simple structure and of such simplicity of fabrication as to make possible fabrication by a person not skilled in the application of mortar or the like.

SUMMARY OF THE INVENTION

Accordingly, objects of the present invention include the overcoming of objections and difficulties and problems of the type not overcome heretofore of the type discussed above, together with additional novel advantages.

Another object is to obtain a combination of elements sufficiently simple in nature as to make possible speedy and high quality fabrication by a person of little or no mechanical ability in the building of a conventional building block wall of building blocks such as cement blocks and/or cinder blocks, or the like.

Other objects become apparent from the preceeding and following disclosure.

One or more objects of the present invention are obtained by the invention described herein.

Broadly the invention includes a new combination of building elements, the method of their assemblage, and the resulting wall: a double-faced strip of opposite flat faces, of lesser width than the blocks and of lesser height than the blocks, having apertures along laterally facing lateral opposite faces thereof; placing an adhesive composition on each of the opposite flat faces of each double-faced strip prior to insertion between opposing ends of building blocks flushly against the opposite flat faces; placing horizontally along an upper face of each of a series of consecutive building blocks a horizontal strip having upper and lower faces and coated with an adhesive composition on each of the horizontal strip's upper and lower faces, and the horizontal strip being of a width of lesser width than the width of the block; placing on top of the coated horizontal strip's upper face a second tier of building blocks in series with additional end strips between consecutive serially arranged ones of the building blocks of the second tier; and applying a binder composition to grooves formed between ends of consecutive blocks and between upper and lower tiers of consecutive blocks.

More particularly, there is included as a part of the inventive structural combination an elongated strip in the form of a sheet having each of opposite faces parallel with laterally facing apertures in the respective edges, and with the respective edges being spaced apart from one another by a width of the elongated strip slightly less than the width of the blocks with which the strip is to be employed such that when blocks are mounted on top of the elongated strip or the elongated strip mounted on top of the tier of blocks, the edges of the strip do not extend to the edges of the block resulting in the effect that from multiple tiers there is formed between the respective tiers with the respective opposite edges of the elongated strip serving as the inner base-face facing laterally of the wall as the base of the respective grooves. Each elongated lateral strip includes on each of upper and lower surfaces thereof a coating of setable composition of a pliable nature prior to setting, preferably of tar components, coating each of the upper and lower surfaces, the upper and lower surfaces of the elongated strip preferably being substantially flat, but it of course being possible for there to be surface irregularities but with the overall upper and lower surfaces each extending substantially flatly in parallel planes to one-another, and the strip preferably being corregated cardboard thereby forming the required apertures as hole opening between serially arranged wrinkles of the corrugated portion of the corrugated cardboard of a conventional type, these apertures being critical to the invention as is the width of the elongated strips being also critically less than the width of the blocks in order that the grooves formed along the respective block edges between tiers or between a block bottom edge face and a supporting foundation, being receivable of a mortar or other setable composition within a groove whereby upper and lower groove block edges of respective upper and lower tiers or surfaces to be attached such as a bottom tier and a supporting foundation, are available for which and to which the adhesive composition such as the mortar may fixedly secure when painted into the groove or puddied into the groove or otherwise placed into the groove and also such that the setable cementing composition pressed into the groove may be pressed into the passages of the holes of the apertures serially located along the corrugated edge of the corrugated cardboard in order to form an anchoring mechanism for securing against any possibility for the groove composition coming unstuck or from tending to crack and fall out of place or the like. Such mechanism also assures the ease of an assurance of the composition placed into the groove having something to hold onto. Thereby the application of the composition is simplified sufficiently for application by a person without any substantial degree or amount of such experience or skill from the past. Once the composition, or for example a cord around which a composition is formed or coated, is pressed into the groove and into the groove base apertures, a spatula or other smoothing instrument may be used for running along the edge or surface of the lateral surface of the opposing tier blocks in order to smooth out the seams being covered. In like manner, there is preferably also a part of the combination end-fin gasket strips extending uprightly preferably with the apertured corrugated edges thereof also facing laterally outwardly from the wall and being of a similar width as the elongated strip(s) — i.e. about the same as the block width but less than the block width of the block with which it is to be employed in order that between respective opposing ends of consecutively serially arranged blocks there may be also formed a groove and a groove composition anchoring mechanism anchoring mechanism of the type described above. This end gasket similarly has coating on each of opposite faces. A particular advantage of the coating composition on each of opposite faces of the respective elongated strip and end gasket strips, is that such allows a person to set the strip in a desired position and the strip will tend to stay in that position, but later however, the strip may be settled downwardly into level position or such position as is required for the strip to seat itself between possible irregularities above and below in upper and lower surfaces of respective blocks of consecutive tiers one on top of the other, the coating being of sufficient thickness as to allow for give and take in the seating of the strip and in the seating of the tier blocks thereon, particularly in facilitating the leveling thereof, by appropriate pressures applied thereto, and in the leveled state the mortar or other groove composition would be applied and allowed to set or harden. Thus, the blocks can be pressed downwardly into the thick layer of tar composition for the adjustment of the blocks, without the person or artisan having to use mortar on top of the blocks — such an operation if required complicating such an operation; however, mortar may be utilized at these points if desired. Concurrently the parallel opposite edges of the respective elongated strip(s) facilitate alignment of the blocks, and similarly the end-fin gasket strips with their respectively opposite faces having thick tar coatings (or equivalent setable composition) serving to facilitate the matching of ends of the blocks and in the aligning thereof by it being possible to adjust the blocks in the yieldable tar, for example. The height of the end-fin gasket strips preferably is less than the height of the blocks such that also there is defined a groove across the upper and lower edges of abutting end faces of serially arranged consecutive blocks, this groove extending horizontally along the width of the blocks. Although the end-fin gasket strip is preferably arranged uprightly with the corrugated pore or aperture opening facing laterally away from the wall face, it is within the scope of the invention to employ the end-fin gasket strip extending laterally with the corrugation apertures facing upwardly and downwardly.

Therefore, with an understanding of the fabricating elements or components as set forth above, it may be understood that the novel process includes the employment of such elongated horizontally extending strips preferably of corrugated cardboard coated on each of flat broad faces thereof and the end strips similarly constructed as described above, and the groove-binding composition or coated cord as described above, the process including the utilization of the strip such as the corrugated cardboard, applying tar to each of the opposite broad faces thereof consecutively or concurrently, and physically mounting such strip on a foundation and thereafter mounting a tier of blocks on top of the tar-coated strip, and placing a strip on top of the bottom tier and a second tier on top of that strip, as well as the mounting of the end strips between the consecutive serially arranged blocks of each tier, and filling-in the pitch or motar or other binding material by merely painting it into the groove or by using a blade or the like or preferably utilizing the cord composition coated and pressing it into the groove, the cord being a string or line or plurality thereof.

Each elongated strip preferably includes visually discernable markers such as indicators each foot of distance, for facilitating the laying of the wall for predetermined distances and the like.

THE FIGURES

DETAILED DESCRIPTION OF THE INVENTION

Figure 1:
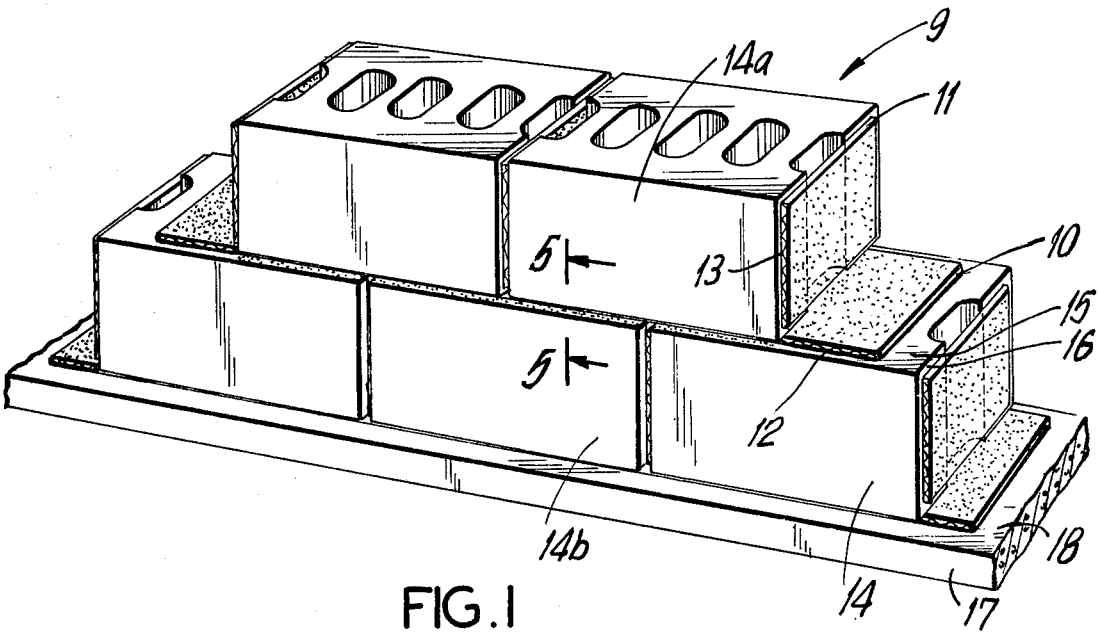
FIG. 1 illustrates a side perspective view of a typical wall partially fabricated and in an in-part view thereof.

In greater detail, FIG. 1 illustrates a partially erected building block novel wall 9 including the elongated corrugated cardboard strip 10 having upper and lower surfaces thereof coated with tar composition, and the end-fin gasket strips 11, with the corrugated strip apertures of the elongated strip 10 identified as apertures 12 and the side apertures 13 of the fin gasket strip 11 side laterally-facing surface being similarly identified. The building blocks are identified as 14, including the blocks of respectively arranged tiers thereof blocks **14*a* and 14*b*. The upper surface of the building blocks are substantially extending in a flat plane as flat surface 15 for example. In like manner, the ends of the blocks have end faces thereof extending in a linear plane such as flat surface 16 extending in substantially a common flat plane throughout, minor steps and/or holes not altering the generally flat plane of flushly alignable opposite faces of opposing end faces of consecutively serially arranged blocks, such as illustrated in the FIG. 1 for example. The original first strip to be laid would normally be mounted on an upper surface of a flat face 18 in a horizontal plane as of a foundation 17** which may however be a concrete slab or strip or other suitable non-deteriorating composition, even of possibly metal for example.

Figure 2:
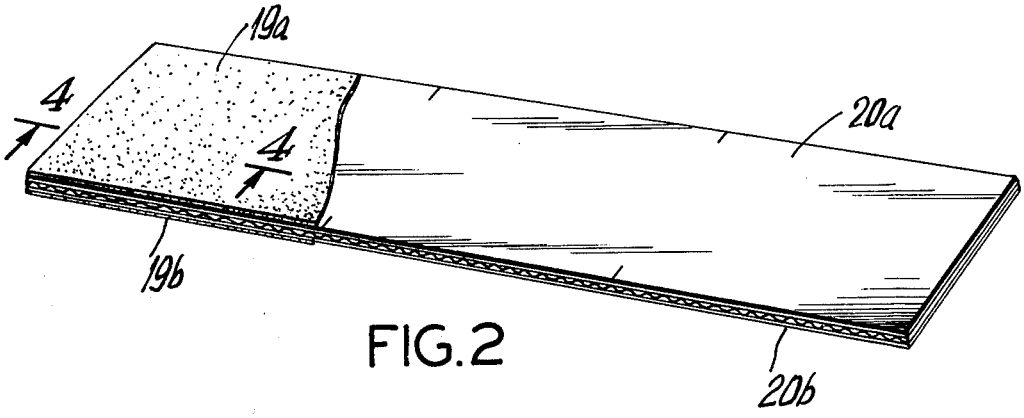
FIG. 2 illustrates in an enlarged end side perspective an in-part cut-away view of an elongated invention.
Figure 3:
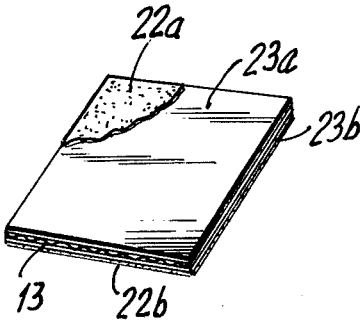
FIG. 3 illustrates a corresponding perspective view of an end-fin gasket strip in side perspective and in-part cut-away view.
Figure 4:
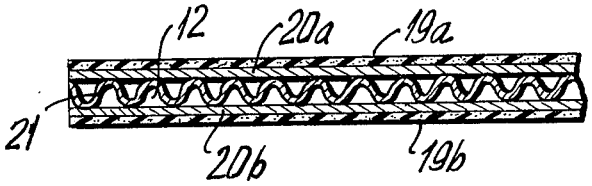
FIG. 4 illustrates a view in in-part and cross-sectional view of the embodiment of FIG. 2 as taken along lines 4—4 thereof.

FIG. 2 illustrates an enlarged view of the elongated strip 10 in a partial cut-away of the upper and lower tar-coated surfaces. On an upper surface there is a tar coating **19*a* and on a lower surface there is a tar coating 19*b* on respectively the upper corrugated cardboard surface 20*a* and lower surface thereof 20*b*. In the cross-sectional view of FIG. 4, there is illustrated the typical nature of the corrugation strip 21 laminated between the parallel upper and lower faces 20a and 20b having tar coatings 19a and 19b and the laterally-facing apertures 12 between respective portions of the corrugated element 21 of overall sheet 10. The end fin gasket strip of FIG. 3 is of similar construction as that of the elongated strip 10, differing in construction only in the shape and position of insertion between the opposing flushly end to end consecutive serially arranged building blocks. Accordingly, the fin gasket strip of FIG. 3 has the upper-surface tar coating 22a and the lower-surface tar coating 22b on respectively the upper and lower faces 23a and 23b, with the apertures 13** being defined in a laterally-facing surface thereof.

Figure 5:
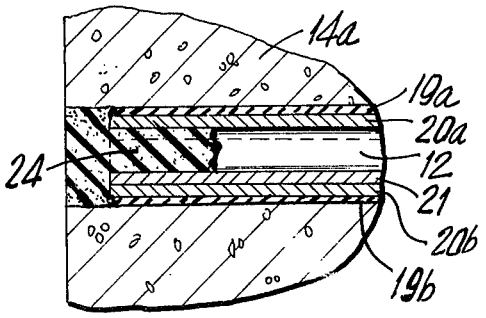
FIG. 5 illustrates a side cross-sectional and an in-part view as taken along lines 5—5 of the assembled building block wall of FIG. 1.

FIG. 5 more aptly illustrates in cross-sectional in-part view of the wall of FIG. 1, as taken along lines 5—5 thereof, the mechanism of the applied composition 24 which is pressed into the aperture 12 in order to anchor the composition into the groove which concurrently adheres the lower face edge of the block 14a and the upper face edge of the block 14b adhesively together, and showing the relationship of the respective layers of the corrugated cardboard.

Figure 6:
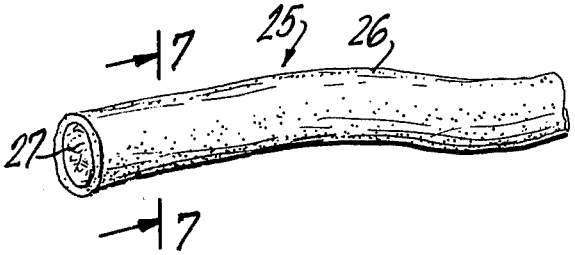
FIG. 6 illustrates an in-part view of a side perspective view of a preferred cord composition binder material for pressing into grooves formed between respective ends and sides of serially arranged blocks of a common tier and between consecutive tiers one over the other within the grooves therebetween.
Figure 7:
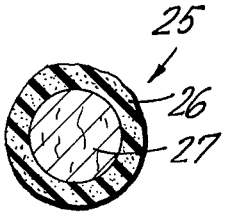
FIG. 7 illustrates a view taken along line 7—7 of FIG. 6 shown in cross-sectional view.

FIG. 6 illustrates a preferred cord-like groove-binding composition in perspective and in-part side view, including the illustration of the central cord solid line material and the coating therearound of binding composition 26 to form the overall cord device 25. For a more clear understanding of the relationship of these parts, FIG. 7 is taken along the line 7—7 of FIG. 6 and illustrates in cross-sectional view these various above-noted components of the cord device.

Figure 8:
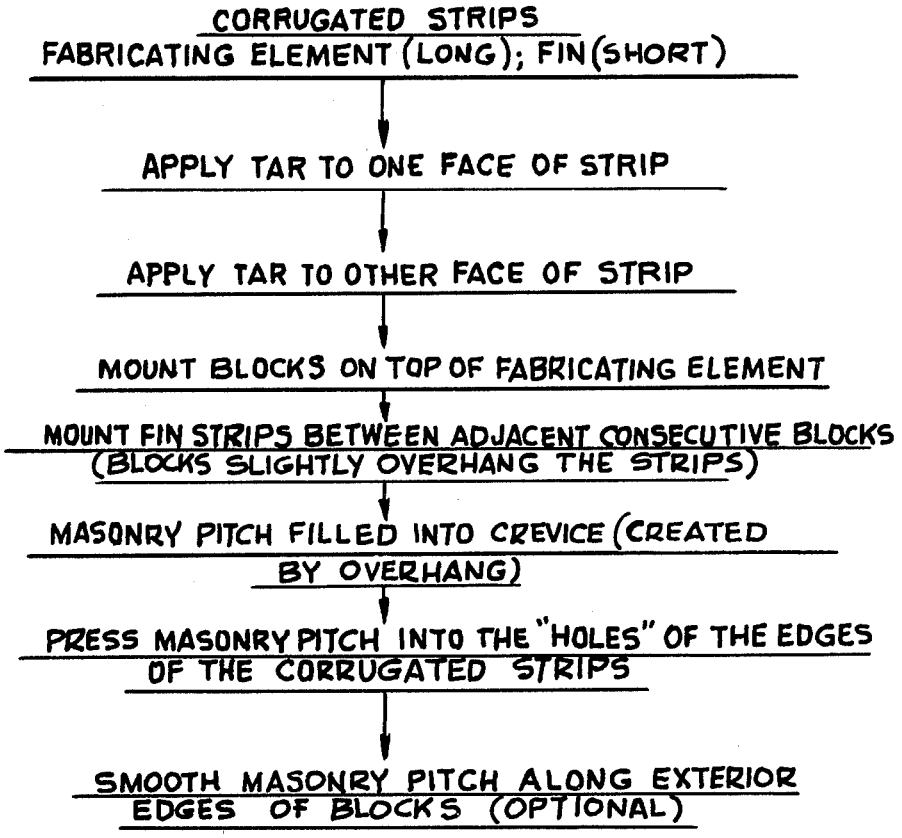
FIG. 8 illustrates a flow diagram of the typical and inventive process of the present invention utilizing the fabricating elements and/or components thereof.

FIG. 8 illustrates a typical process as to the consecutive steps of a preferred embodiment thereof utilizing the fabricating elements and/or components of the invention as enumerated above, in particular, including for example, the first step of employing corrugated strip such as the elongated horizontal horizontal strip and the end-fin gasket strip each of corrugated cardboard having thereafter the steps of applying tar to the one broad face and the other broad face of each, and for example, for consecutive tiers of blocks mounting blocks on top of the fabricating element which is mounted on top of either a foundation support such as a foundation support 17 of FIG. 1 on the flat face 18 thereof, or on the top of the strip such as the blocks 14a on top of the elongated strip 10 which is on top of the blocks 14b. Concurrently when mounting the blocks of a common tier, the end fin gasket strips are mounted between the opposing end to end faces of the consecutive serially arranged blocks of a common tier, and aligning the lineal direction of a series and/or leveling or otherwise seating the plurality of blocks and tiers relative to one another by maneuvering and pressing downwardly and/or laterally on respective blocks which are adjustable in the thick tar coating allowing easy and correct adjustment and alignment of blocks and tiers thereof.

The invention includes obvious variations and modifications and substitution of equivalents obvious to a skilled artisan. By the present invention, there results an aesthetically appealing and acceptable building block wall having improved durability and ease of assemblage from low cost materials by a person of less than professional skill.

I claim:

1. A method of fabricating a building block wall comprising in combination: lineally serially aligning end to end a series of building blocks; placing between serially consecutive block ends and between consecutive tiers, an elongated sheet structure means of a first predetermined thickness having each of opposite lateral side faces extending longitudinally along the sheet structure means in substantially parallel alignment with one another and each of the parallel lateral side faces defining aperture structure forming a series of laterally-facing apertures, the sheet structure means being of a second predetermined width such that the predetermined width is less than a building block with which the sheet structure means is to be employed, and the sheet structure means including on each of upper and lower faces thereof a binder composition coated along upper and lower faces of the sheet structure means.

2. Building blocks fabricating-element device of claim 1, in which the placing of the sheet structure means comprises employing corrugated cardboard strip having upper and lower substantially flat faces, and employing as the binder composition a tar material of third predetermined thickness sufficient for the setting and adjusting of blocks therein along an upper face of the cardboard strip and sufficient for concurrent setting and adjusting of the cardboard strip on a supporting surface therebeneath, each of the strips is of a fourth predetermined length of a length dimension longer than a building block with which the sheet structure means is to be employed such that the strip covers the length of more than one building block and such that more than one building block length may be placed onto the strip concurrently, in longitudinally extending series with adjacent building blocks.

3. Building blocks fabricating-element device comprising in combination: an elongated sheet structure means of a first predetermined thickness having each of opposite lateral side faces extending longitudinally along the sheet structure means in substantially parallel alignment with one another and each of the parallel lateral side faces defining aperature structure forming a series of laterally-facing exposed recess-spaces, the sheet structure means being of a second predetermined width such that the predetermined width is less than a building block with which the sheet structure means is to be employed, and the sheet structure means including each of upper and lower faces thereof and an exposed binder composition exteriorly coated along the upper and lower faces of the sheet structure means, the binder composition comprising substantially a tar material as an outer-coating of third predetermined thickness sufficient for the setting and adjusting of blocks therein along an upper face of the cardboard strip and sufficient for concurrent setting and adjusting of the cardboard strip on a supporting surface therebeneath, the sheet structure comprising corrugated cardboard strip having substantially flat upper and lower faces, and end-gasket strips each of a fifth predetermined length of a dimension less than a predetermined building block to be employed therewith extending vertically across the end of each of opposite ends of the building block, with each of opposite lateral side faces including serially additional aperature structure forming an additional series of laterally-facing exposed recess-spaces, there being the tar material on each of opposite broad faces of the respective end-gasket strips, and the end-gasket strip being of a sixth predetermined width of a dimension less than the width of the building blocks with which the end-gasket strips are to be employed, and groove filler composition, the groove filler composition being a setting-type binder, and a plurality of building blocks of substantially cuboid shape having upper and lower and opposite end substantially squared faces relative to other sides such that consecutively serially arranged building blocks are lineally alignable with one another and such that building blocks placed one on top of the other with the sheet structure means strip therebetween are substantially lineally alignable upwardly with one another insofar as lateral faces thereof.

4. Building blocks fabricating-element device comprising in combination: an elongated sheet structure means of a first predetermined thickness having each of opposite lateral side faces extending longitudinally along the sheet structure means in substantially parallel alignment with one another and each of the parallel lateral side faces defining aperature structure forming a series of laterally-facing exposed recess-spaces, the sheet structure means being of a second predetermined width such that the predetermined width is less than a building block with which the sheet structure means is to be employed, and the sheet structure means including each of upper and lower faces thereof and an exposed binder composition exteriorly coated along the upper and lower faces of the sheet structure means, and a plurality of building blocks of substantially cuboid shape having upper and lower and opposite end substantially squared faces relative to other sides such that consecutively serially arranged building blocks are lineally alignable with one another and such that building blocks placed one on top of the other with the sheet structure means strip therebetween are substantially lineally alignable upwardly with one another insofar as lateral faces thereof.

* * * * *